United States Patent [19]

Leuenberger

[11] Patent Number: 4,608,764

[45] Date of Patent: Sep. 2, 1986

[54] PROCESS OF DRYING A PARTICULATE MATERIAL AND APPARATUS FOR IMPLEMENTING THE PROCESS

[75] Inventor: Hans Leuenberger, Pfeffingen, Switzerland

[73] Assignee: Glatt Maschinen-und Apparatebau AG, Pratteln, Switzerland

[21] Appl. No.: 735,264

[22] Filed: May 17, 1985

[30] Foreign Application Priority Data

May 19, 1984 [CH] Switzerland ..... 2484/84

[51] Int. Cl.[4] ..... F26B 5/06; F26B 13/30

[52] U.S. Cl. ..... 34/5; 34/92

[58] Field of Search ..... 34/5, 92

[56] References Cited

U.S. PATENT DOCUMENTS

| | | | |
|---|---|---|---|
| 1,461,148 | 7/1923 | Hughes | 34/92 |
| 2,402,401 | 6/1946 | Hickman | 34/5 |
| 3,394,468 | 7/1978 | Zeller | 34/57 |
| 3,436,837 | 4/1969 | Abelow et al. | 34/5 |
| 3,513,559 | 5/1970 | Eilenberg | 34/5 |
| 3,818,605 | 6/1974 | Glatt | 34/57 |
| 4,175,334 | 11/1979 | Gibert | 34/5 |
| 4,318,771 | 3/1982 | Grab et al. | 159/16 |
| 4,476,804 | 10/1984 | Glatt et al. | 118/19 |

FOREIGN PATENT DOCUMENTS

| | | | |
|---|---|---|---|
| 3204466 | 10/1982 | Fed. Rep. of Germany . | |
| 952920 | 3/1964 | United Kingdom | 34/5 |

*Primary Examiner*—John J. Camby

*Attorney, Agent, or Firm*—Fleit, Jacobson, Cohn & Price

[57] ABSTRACT

The particles of the particulate material to be dried are cooled before the drying operation proper, or in the initial phase thereof, to a temperature low enough to make the liquid to be extracted solidify. At least the drying operation proper is carried out in a space bounded by a container, in which a gas, more particularly air, is passed through the particles. While in said space, the particles are subjected to motion, for example, they are whirled by the gas to form a whirling layer. The temperature of the gas is adjusted to have at least a considerable part of the drying operation take place by sublimation, the heat energy required for the sublimiation being supplied to the particles at least in part by the gas passed through them. In this way, the particulate material may be dried with care and nevertheless in relatively large batches, and with limited time expenditure.

27 Claims, 5 Drawing Figures

PROCESS OF DRYING A PARTICULATE MATERIAL AND APPARATUS FOR IMPLEMENTING THE PROCESS

BACKGROUND OF THE INVENTION

1. Field of the Invention

The present invention relates to a process of drying a particulate material, in which a gas is passed through the particulate material. The particulate material is held at least during a part of the drying process at a temperature, at which at least one part of the substance to be extracted from it is in the solid state. The invention also relates to an apparatus for drying a particulate material. This apparatus comprises a container to receive the particulate material to be dried, and means to pass the gas through the particulate material. At least one cooling means is provided for cooling the particulate material.

2. Description of the Prior Art

Sublimation drying processes are known in the art. In a process of this kind a material to be dried, or more accurately, the water contained in the material and intended to be extracted from it during drying, is frozen before the drying operation and then transformed into vapor by sublimation. The material is usually dried in batches in evacuated containers, in which it rests motionless on a support surface. The heat required for sublimation is supplied to the material either by way of a contact surface, through heat conduction, or by radiation. The vapors developing during the drying are usually frozen on cold surfaces, or sorbed by some means of sorption, or sucked off by steam ejector pumps.

In as much as a particulate material present in an evacuated space possesses but low heat conductivity and since furthermore the vapor generated during the drying process can leave the material only with relative slowness from a material resting motionless on a support surface, there follows that a layer of such a material resting on said support surface cannot be but comparatively thin, to avoid excessive slowness in the progress of the drying process. Thus, only relatively small quantities of the material may be dried per batch in a container. In order to avoid any melting of the ice at the boundary surface of the particulate material at which the latter receives heat by conduction or radiation, it is necessary to keep the quantity of heat supplied per unit of time very small because of the low heat conductivity of the particulate material. The time requirements for drying thus become very high, even if the batches and the layer thicknesses of the material are low.

It is further known to have a material to be dried in a stationary container subjected to whirling by means of a current of warm air, so that the whirling layer is formed by the material. It is also known to dry a material in a drum-shaped rotated container provided with a perforated wall, by passing warm air through the particle bed provided in the container and through the zone of the perforated wall covered by said particle bed. Attention is called in this connection to the International Disclosure Publication WO 82/03972 and corresponding U.S. Pat. No. 4,543,906, as well as U.S. Pat. No. 4,476,804. It is also known to move the material within a stationary container by means of a movable member engaging the material, while air or nitrogen is passed through the material and the container wall is heated. All these processes in which the material is heated relatively intensely can have disadvantages when drying materials consisting of thermolabile substances or having a porous structure to be left unchanged during drying.

SUMMARY OF THE INVENTION

The present invention has as one of its objects the provision of a method of drying a particulate material, in which gas is passed through the particulate material and at least part of the substance to be extracted is in solid state during at least part of the drying process, whereby the disadvantages of the known processes are eliminated to the maximum possible extent.

Another object is to provide a method of drying a particulate material suitable for use for thermolabile particles.

Another object is to provide an improved apparatus for drying particulate materials in a container, said apparatus comprising means for passing gas through the particulate materials.

The foregoing and another objects are attained in accordance with one aspect of the present invention by providing in a process for drying a particulate material, in which a gas is passed through the particulate material, for the latter to be held at least during part of the drying process at a temperature, at which at least one part of the substance to be extracted form in is in the solid state. In the apparatus for drying a particulate material and comprising a container to receive the particulate material to be dried and means to pass the gas through the particulate material, provision is made for at least one cooling means for cooling the particulate material.

The process and the apparatus of the invention make a careful drying possible and are suited particularly for particles of thermolabile materials, whereby any pores existing in the particles and filled with liquid before the drying remain preserved to a large extent. It is also possible to dry comparatively large batches in one container in a relatively short time. Thus it is readily possible for example, to design an apparatus, such as a whirling layer drier, for drying batches as large as 1000 kg, whereby a batch of this size may be dried, in dependence of the constitution (structure) of the particulate material, in a comparatively short time, such as a few hours or even less than one hour.

The process and the apparatus of the invention may be used for example for drying medicinal drug particles or intermediate products to be used for the manufacture of such particles, furthermore for drying soluble coffee, tee, soluble fruit components and other instant products, as well as foods and products containing nutrients, fertilizers, plant protecting agents and seeds.

The drying operation proper is performed to advantage on a particulate material in a space constituted by the inside space of a container and is tightly closed with respect to the surroundings. The substance to be extracted from the particulate material normally exists, if at room temperature and under the conditions prevailing before the drying operation, in liquid form in or on the particles of the particulate material to be dried. Accordingly, the drying operation may be carried out only if the substance to be extracted is changed over at least partially form the liquid to the solid state by subjecting the particulate material to a cooling operation. This operational step in which the liquid is at least partially made to solidify, may be carried out, selectively, inside or outside the space closed-off with respect to the surroundings, in which space the particulate material is then dried at least partially by sublimation.

The particulate material to be dried may already exist as particulate material before it is cooled for the purpose of solidifying the substance to be extracted therefrom. The particulate material to be dried may consist for example of particles containing at least one pharmaceutical "active substance", such as vitamin C or peniciline V, and about at least one additional substance, such as mannite, or a dissacharid such as lactose or sucrose, or any other carrier or binding agent, and/or aromatic substances. It is, however, also possible to cause to solidify a particulate material originally existing as a liquid, such as a watery solution containing for example dissolved vitamin C and perhaps other dissolved substances, or a liquid containing solid particles in suspended form, by subjecting them to cooling. The product obtained in this way and having the shape of a comparatively large solid block can then be crushed and/or growned and/or milled or the like, so as to produce a particulate material that can be dried in accordance with the process of the invention. There are also other possibilities. The particulate material may for instance, be solidified in a solidification form or mould adapted to yield during solidification comparatively small particles.

The process of the invention may be carried out by introducing a particulate material, with the sole purpose of being dried, into the space bounded by the container of an apparatus, in which the gas is passed through the particle material, the latter being imparted a motion. It is also possible, however, to previously subject the particulate material in the same container to a different treatment, in which the moist particles to be subsequently dried, are produced. The originally existing particles may be agglomerated for instance to larger particles, while a liquid is added thereto, or they may be coated with a coating, and subsequently dried in the same container in accordance with the invention, whereby the solidification of the substance to be extracted is carried out in the same container, preferably preceding the drying operation. If, on the other hand, at least one large solid block is produced by solidifying a solution in the manner described before, which block must be subsequently crushed so as to form the particulate material to be dried, it may under suitable circumstances also be possible to perform this crushing and/or grinding treatment in the same container, in which the particulate material is subsequently dried by sublimation.

The process of the invention serves primarily the purpose, to extract water from the particulate material in the process of drying. However, particles may be dried from which instead of water a different chemical substance, for example an organic solvent, such as alcohol or isopropanol, or a mixture of various substances, must be extracted.

The gas passed during the drying process through the particulate material should be, when supplied to the particulate material, preferably free of the substance intended to be extracted form the particulate material, or should contain the same at most in the form of non-saturated vapor, so as to make rapid drying possible. If while being supplied to the particulate material the gas contains unsaturated vapor, the vapor density should advisable be at most 90%, preferably at most 80%, for example at most 60% and if possible at most 40%, or even approximately or at most 30% or even less of the saturation density. If the gas then comes in contact with particulate material, it absorbs the vapor arising during the drying process and is carried away from the particulate material together with the vapor. The gas passed through the particulate material may thus serve the purpose, to rapidly carry away the vapor arising during drying from the particulate material to be dried. In this connection it is of advantage, to have the vapor density lie below the saturation density too, when the gas has already passed the particulate material in part or completely.

As is known, the solidification and the melting temperature, respectively, of the substance to be extracted from the particulate material depends on the pressure prevailing in the space in which the drying operation takes place. If the substance to be extracted during the drying operation from the particulate material consists of a mixture of substances in liquid form before the drying operation, or if it is merely a component of such a mixture, such as a solvent, in which at least one solid substance destined to remain is the particulate material subsequent to the drying operation is dissolved, then the solidification process and the melting process, respectively, does not in general take place at a solidification or melting temperature, respectively, but rather within a temperature range. In this temperature range one part of the mixture may be liquid and another part may be solid, in dependence of the temperature of the particles of the particulate material and of the mixing proportions of the components of the mixture. Moreover, then often occurs a change of said mixing proportions in the course of the solidification or melting process, because, for example when cooling a liquid mixture only one of its components solidifies at first. In addition, the temperature of the particles, at which the particulate material is dried, may change in the course of the drying operation, or more specifically, it may deviate from the value of the temperature, to which the particles were cooled down to at least partially solidify the substance to be extracted. In such a case the particulate material may be cooled down, for the purpose of solidifying the substance to be extracted therefrom, and subsequently held, at least during one part and preferably during the entire drying operation, at a temperature, at which, at the prevailing pressure, and also in case the substance to be extracted consists of a mixture or at least one component of such a mixture, at least one part but preferably the entire substance to be extracted is actually solid.

Thus, if the substance to be extracted during the drying operation is a pure substance, then the particles are held at least during one part, but preferably at least during the largest part of the drying operation, at a constant or variable temperature at most equal to the solidification or melting temperature, respectively, of the respective pure substance at the prevailing pressure, and is preferably lower than these temperatures. If the substance to be extracted consists of a mixture or of a component of such a mixture, then the particulate material is preferably cooled down to a temperature and held at least during one part of the drying operation at a constant or a variable temperature, at which the entire mixture is in a solid state. In as much as the mixing proportions change in the liquid and solid phases during the solidification and melting process, respectively, it is advisable to cool the particulate material to a temperature and to hold it at that temperature, at which the mixture is solid at all possible mixing proportions and which thus lies below the solidification or the melting temperature range, respectively. If, for example, the mixture has a eutectic state, i.e., it can form a eutectic mixture, then the particles will be preferably held at a constant or at a variable temperature, which at most is equal to the eutectic temperature, or preferably lower than the same.

During the drying operation heat is withdrawn from the particles by virtue of the sublimation of the solid substance to be extracted from them and by virtue of the change of the liquid substance into vapor, which may additionally take place. Because of this heat withdrawal, the particles will be cooled to a temperature lying below the temperature of the gas passed through them. The gas will therefore transfer heat energy to the particles of the particulate material, so that its temperature will drop while it passes through the particulate material. Depending on the specific construction of apparatus used for implementing the process, it may be possible to also transfer heat energy from the walls of the container enclosing the particulate material to the particles, by radiation, and if the particles of the particulate material come in contact with the said walls, by heat conduction. The resulting temperature of the particles to be dried depends on various parameters. Such parameters are the size of the particles, the heat exchange with the gas passing through the particulate material, furthermore, any heat which may be transferred to the particles from warmer surfaces of the apparatus used to implement the process by radiation or by direct contact with such surfaces, and the speed of sublimation. However, this speed of sublimation depends per se on the temperature of the particles as well as on the temperature, the vapor content and the flow velocity of the gas passing through the particulate material, so that the parameters influencing the temperature of the particles exert reciprocal influence on each other too. In case of intense drying, the temperature of the particles may be approximately equal to the temperature of the gas or lie for example up to 10° C. or less, more particularly up to about 20° C. or even 30° C. or possibly up to 40° C. below the temperature of the gas passed through the particulate material.

To make the drying operation take place, on the one hand, as completely as possible by sublimation and, on the other hand, as fast as possible, it is of advantage to hold the particles at a temperature, which lies only slightly below the melting temperature of the substance to be extracted, or below the melting temperature range of the mixture containing at least one component of the substance to be extracted. This aim can be reached by suitably setting the operational parameters, in particular the quantity per unit of time of the gas passed through the particulate material and its temperature, whereby the gas supplied to the particulate material should be as dry as possible, as was mentioned before. In as much as the temperature of the particles resulting during the drying operation depends—in accordance with the foregoing explanations—on various parameters and can also change in the course of the drying operation, one may determine in a few experiments the ways in which the various parameters may advantageously be selected and adjusted to each other. As soon as one has selected the rate of flow of gas through the particulate material and the vapor content of the supplied gas, one may, by measuring the resulting temperature of the particles of the particulate material, proceed to select an appropriate temperature for the gas to be supplied. In this connection there also exists the possibility to change the temperature of the supplied gas and/or the rate of flow of gas through the particulate material and to adjust it to the changeable speed of sublimation and to the correspondingly changing need of heat energy. To this end one may continuously measure the temperature of the particles and perhaps other quantities during the drying operation, such as the temperature and the vapor content of the gas, and then control and/or regulate (without or with feedback) for example the temperature of the supplied gas and/or the rate of gas flow in dependence of the said measurements. The temperatures which the gas has been heated to upon entering the space containing the particulate material, i.e. before it comes in contact with the particulate material, and the temperature which the gas has within the space itself—if a heat exchange between the particulate material and the gas has taken place already—may be for example at least equal to a minimum temperature, which lies about by 20° C. or preferably by 10° C. below the melting temperature of the substance to be extracted, or below the lower limit value of the melting temperature range of the mixture containing this substance. Furthermore, the said gas temperatures may lie perhaps by at most 40° C., or by at most 30° C. or by at most 20° C. or for example by at most 10° C. or not at all above the said melting temperature, or above the lower limit value of the melting temperature range, as the case may be, the said lower limit value of the melting temperature range being equal to the eutectic temperature, if the mixture forms a eutectic. In case the gas temperature and the rate of gas flow through the particulate material have been appropriately selected, then the particles will be supplied by the gas with at least a substantial part of the heat energy they need for drying. The heat energy supplied to the particles by the gas may readily amount to at least 50% and for example to at least 80% and possibly to the total of the quantity of heat which must be supplied to the particles for the sublimation and/or the entire drying operation.

While the particulate material to be dried is subjected to cooling to get the liquid substance to be extracted from it to solidify, a drying process may already take place under certain circumstances. This cooling operation and the subsequent drying operation are, however, preferably carried out in such a way, that at least a considerable part of the substance extracted during the drying operation from the particulate material is extracted by sublimation, said part being advisably at least 50% and preferably at least 80% of the total substance extracted from the material.

The invention, and its objects and advantages, will become more apparent in the detailed description of the preferred embodiments subsequently presented.

BRIEF DESCRIPTION OF THE DRAWINGS

In the detailed description of the preferred embodiments of the invention hereinafter presented, reference is made to the accompanying drawings, in which.

DETAILED DESCRIPTION OF THE PREFERRED EMBODIMENTS

Figure 1:
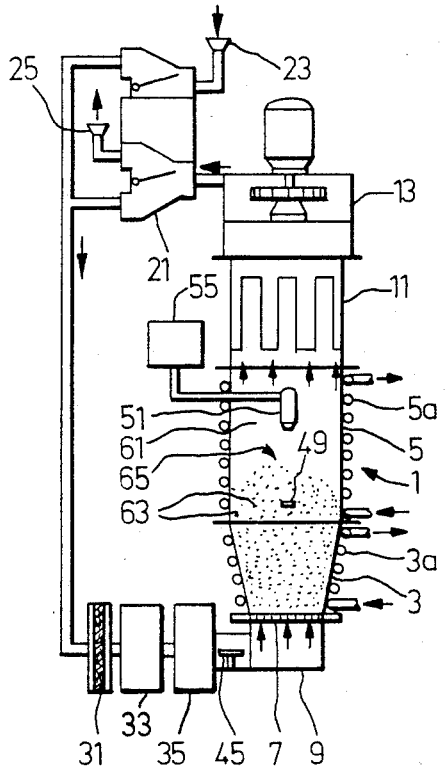
FIG. 1 shows a schematic vertical section through an embodiment of an apparatus for producing a whirling layer.

The apparatus shown in FIG. 1 displays a container 1 fixedly held on a support not shown in the drawing and comprising a conical lower part 3 tapering downwardly and a cylindrical upper part 5. The lower part 3 is provided at its lower end with a gas permeable, sieve-like bottom plate 7; a gas distributor 9 is disposed on the underside of the bottom plate 7 and is provided with an opening facing the plate 7 and being connected therewith. A filter 11 with cylindrical housing is fixedly mounted at the upper end of the upper part 5. A suction device 13 disposed at the upper end of the filter 11 comprises a housing, a blower and a motor for driving the blower.

The walls of the lower and upper parts are each preferably provided with a cooling and/or heating device 3*a* and 5*a*, respectively, for example in the form of a cooling and/or heating coil. In addition to the devices 3*a*, 5*a*, or instead of these, the said walls may each be provided with heat insulation. Also, the lower part 3, the upper part 5, the bottom plate 7, the gas distributor 9, the filter 11 and the suction device 13 are detachably connected with flanges protruding outwardly and connected with each other by screws or any other means of connection.

A conduit connects the exit of the suction device 13 with the entry of a filter 31. The conduit comprises a valve 21, connected for example with an air inlet 23 for admitting air from the surrounding atmosphere, and an air outlet 25 arranged to open into the surrounding atmosphere. The valve 21 comprises at least one shut-off and throttling element, for example two flaps which may be swivelled together. The valve 21 is adapted to distribute the air it receives from the suction device 13 either to the air outlet 25 or to the filter 31, as required, or between the air outlet 25 and the filter 31 in any desired proportion, whereby air may get from the air inlet 23 to the entry of the filter 31 in dependence of the flap setting.

The outlet of the filter 31 is pneumatically connected to the gas distributor 9 by way of at least one gas drying device 33 and at least one gas cooling device 35. The drying device 33 is adapted to at least partially dry the air passed through it and comprises for example a solid adsorption medium or perhaps an absorption medium, as for instance the adsorption medium known under the commercial name Silicagel, or lithium chloride, or zeolite, and may also comprise devices for cooling and or heating the adsorption or absorption medium, as the case may be. The adsorption or absorption medium may be held for example on a wheel, which rotates during operation and in one angular range it dries air passing through, and in another angular range it becomes regenerated. The cooling device 35 may comprise a cooling coil for passing a cooling fluid or some cooling medium, and may comprise, in addition, devices for setting and changing the temperature, to which the air flowing through is cooled down. The cooling device 35 may also serve for drying the air flowing through it, by removing the water vapor contained in the air supplied, by condensation and/or by freezing it out of the air. Both devices 33 and 35 may be adapted to be operated selectively in discontinuous or continuous operation. It may also be possible to dispense with a separate drying device altogether and accomplish both the drying and the cooling of the air in the same device.

A temperature sensor 45 destined to measure the temperature of the air supplied, and perhaps a sensor for measuring the air humidity, is provided in the conduit connecting the cooling device 35 with the gas distributor 9, or in the gas distributor 9 itself. Furthermore, at least one additional temperature sensor 49 is provided in the container 1 and destined to measure the temperature of the gas and/or particles present in the whirling layer during operation, and perhaps a sensor for measuring the absolute and/or relative air humidity. The upper part 5 of the container 1 additionally comprises at least one cooling medium supply member 51 consisting for example of a spraying member provided for example with a nozzle directed downwardly, or of a sprinkler-like liquid distributor. The supply member 51 could, however, be provided in the lower part 3 of the container 1 and adapted to generate at least one jet of cooling medium, or it may just consist of an inlet opening and a connection. The supply member 51 is connected or connectable, by way of a conduit, with a feeding device 55 or the conduit being provided, if needed, with a shutting valve not separately shown in the drawing.

The apparatus may also comprise additional components not shown in the drawing, for subjecting the particulate material, before it is dried in the container 1, to another treatment process, such as to have the original particles agglomerated in a whirling layer into larger particles, and/or to coat them with a coating. To this end means could be provided for introducing into the container 1 into a specific portion thereof, instead of cooled air or in addition thereto, air pretreated in a different way, for example heated and/or provided with an additional substance, and or for spraying a material onto the particles.

An electronic device, not shown in the drawing, may also be provided for controlling and regulating, with or without feedback, the suction device 13, the valve 21 and the device and the devices 33, 35 and 55, or at least one part of these components. The control and or regulation may be accomplished manually, by actuating switches, and/or at least in part automatically. The automatic control may be realized in accordance with a fixed predetermined operational sequence and/or based on measurements. For this purpose, the temperatures measured by means of the temperature feelers 45, 49 may be used for the control and the regulation of the cooling device 35.

The lower part 3 may be separated transiently from the rest of the container 1 for the purpose of introducing a batch of the particulate material to be dried into the space 61 bounded by the container 1 and tightly closed-off from the surroundings, i.e., into the inner space of the container. It is, however, possible, to dry a material previously treated in the container and thus located already in it. In a previous treatment of this kind, the originally existing particles may have been agglomerated in a whirling layer to larger particles or coated with a coating, so that the particles now present in the space 61 are moist.

The moist particles 63 to be dried are first cooled, to make the substance destined to be extracted (removed) from them and which was previously in liquid state, become at least partially but preferably completely solid (frozen). For accomplishing this solidifying or rigidizing process the particles 63 may be cooled for example by sucking the air cooled by the cooling device 35 through the bottom plate 7 and the space 61. In this case, the rate of air flow in this phase may be optionally set to be either large enough to impart to the particles a whirling motion, or small enough to let the particles more or less rest motionless on the bottom of the container 1. Moreover, the walls of the lower and upper parts of the container 1 may be cooled by means of the devices 3*a* and 5*a* to below the melting temperature.

If cold air is passed through the particles for solidifying (freezing) the liquid present within or on the particles, the latter will become dried to a certain extent, during the process of solidification already. If this is undesirable or if for other reasons the solidification process is to be completely preferably fast, one may bring a cooling medium which consists of solid particles such as dry ice powder, or of a liquid gas, such as liquid air or liquid nitrogen, or of acetone with carbon dioxide dissolved therein, in direct contact with the parts to be dried and then again separate them from the particles by evaporation or volatilization. If for example the particles 63 to be dried have been formed, before the drying process in the space 61, into a whirling layer, by agglomeration or in a coating process, one may introduce dry ice powder into the whirling layer at the end of those preliminary treatment by means of the cooling medium supply member 51 built like a pulverizer (atomizer), and then interrupt the air supply, to make the particles 63 and the dry ice powder intermix and settle on the bottom of the container. If the process of solidification is to be carried out by means of a liquid cooling medium, one may allow the medium to trickle over the particles 63 resting on the bottom of the container 1 from a spraying member 51 designed for example in this case as a sprinkler. The gas generated during these processes from the dry ice, or from the liquid cooling medium during the cooling of the particles 63, may be sucked off by means of the suction device 13. If the solidification process is to be carried out in this way, the two flaps of the valve 21 may be adapted to be adjustable independently from each other, or else the valve 21 may be replaced by at least two separate valves, so that an appropriate valve setting becomes possible, for enabling the removal of the gas developing from the dry ice or the liquid cooling medium by suction, without risking any air to be sucked off at he same time through the bottom plate 7 or generating a whirling layer.

Furthermore it is possible, to introduce into the container 1 a cooling medium, such as dry ice powder, by transiently separating the bottom part 3 from the remaining part of the container. The solidification process may also be carried out on particulate material located outside the container 1, the particulate material being then introduced into the container 1 after having been solidified. Moreover, a substance existing in liquid state, such as a solution, may not be brought to solidify, unless it is first cooled. The blocks produced under such circumstances may then be mechanically crushed and/or ground in the solidified state, to thus produce the particulate material to be dried. The crushing or grinding operation may be performed either outside the container 1 or inside thereof; in the latter case a chopper or a similar mechanical device must be provided within the container.

The suction device 13, in operation at least during the drying process, is adapted to generate the air currents indicated in FIG. 1 by arrows; other arrows in FIG. 1 are indicative of the fluid currents supplied to the devices 3*a*, 5*a* serving for cooling and/or heating and of the fluid currents that lead away from these devices. It will now be assumed, that the liquid to be removed from the particles 63 is water, in which a solid substance may be dissolved for example, which will remain on the particles 63 after they have been dried. After the water or the solution has been frozen in one way or another, and has been made into ice, the air cooled in the cooling device 35 is sucked by the suction device 13 through the space 61, from the bottom to the top, so that the particles 63 are whirled up and fluidized so as to form a whirling layer 65. In this whirling layer the ice will be transformed by sublimation into water vapor and carried by the air passed through the space 61 for the purpose of generating the whirling layer from the whirling layer 65 upwardly, and away from the particulate material, and is sucked off by the suction device 13, together with the air in the form of a mixture of air and vapor. In this way, the particles 63 become dried.

During the drying process, the air supplied into the space 61 for generating the whirling layer 65 is cooled by means of the cooling device 35 to a temperature low enough, to assure, that the ice present in the particles 63, or the solidified solution present in the particles 63 remain in solid state at least during a considerable part of the drying process, and preferably until the particles are completely dried. Since, on the other hand, the air is to supply the particles at least a considerable part of the heat energy required for sublimation, the air temperature is preferably set to make the temperature of the particles 63 lie only slightly below the melting temperature range of the ice or the melting temperature range of the solidified solution, as the case may be. If the melting temperature of the ice is not lowered by a substance admixed thereto, and if the pressure in the space 61 does not deviate to any great extent from the surrounding pressure, then the temperature at which the air enters the space 61 may amount to at least about −20° C., preferably at least about −10° C., and, as the case may be, at most about 30° C. or at most 20° C. or only at most +10° C., and for example about 0° C. Attention is called here to the criteria mentioned in the introduction for setting the gas temperature.

During the drying process the temperature of the supplied air may be measured by means of the temperature sensor 45, whereas the temperature of the gas and/or particles 63 inside the container 1 in the whirling layer 65 may be measured by means of the temperature sensor 49, whereby the results of these measurements may be used for the control of the suction device 13 and/or the cooling device 35.

In order to avoid the melting of the ice by the particles 63 which necessarily come in contact with the walls of lower part 3 and the upper part 5, it is possible to cool these parts 3, 5 by means of the devices 3*a*, 5*a* if the cooling by the cold air is not sufficient. As a matter of fact, the sievelike bottom plate 7 is cooled by the air passing through it to approximately the temperature of this air; however, it could be cooled, if required, by means of an additional cooling device. If the particles do not come in contact with walls of the container 1, or only rarely and for short time intervals, the cooling of these walls may be dispensed with and instead, they could even be heated slightly, to make the particles 63 receive additional heat energy by heat conduction during the contact of the particles with the walls and by radiation from the walls.

The air supplied through the bottom plate 7 into the space 61 is dried initially in the drying device 33 and then perhaps additionally in the cooling device 35. By an appropriate setting of the valve 21 one may selectively determine, whether the devices 33, 35 should be fed by air sucked through the space 61 by the suction device 13, and/or by fresh air.

Since an extensive heat exchange takes place between the air and the particles 63, and since the vapor generated during drying is carried off very fast, the particles may be dried relatively fast in spite of the relatively low temperature, if the operational parameters are properly set.

Figure 2:
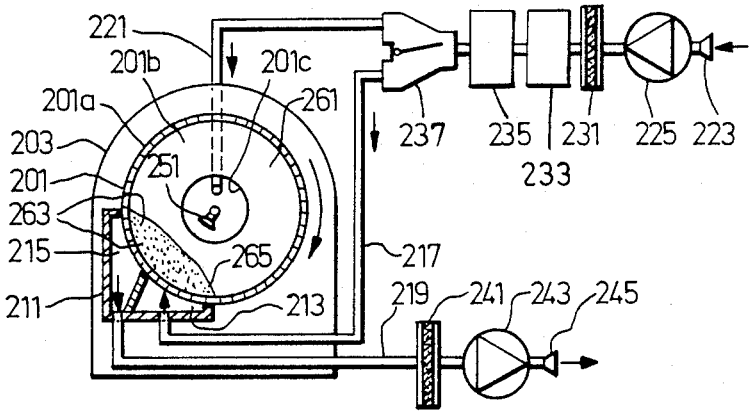
FIG. 2 shows a schematic vertical section through an embodiment comprising a rotatable container with perforated wall and means for passing air through a particle bed provided in the container.

The apparatus shown in FIG. 2 comprises a drum-like container 201 disposed within the inner space of a housing 203 closed-off gastight with respect to the surroundings. The container 201 is supported, by means of supporting means not shown in the drawing within a frame connected with the housing 203, rotatably around an axis disposed at an angle with respect to the vertical, more specifically around a horizontal axis of rotation, and may be rotated by means of a driving device not shown in the drawing. The container 201 comprises a wall in the shape of a cylindrical shell 201*a* at least partially perforated and connected at its both ends with a conical wall part 201. At least one of the central regions of the container faces is provided with an opening 201*c*. A gas transmitting shoe 211 is adjustably connected with the frame and the housing 203. The gas transmitting shoe 11 has a box-like shape and is open at its side facing the axis of rotation of the drum, the inner space of the gas transmitting shoe being subdivided into two chambers 213, 215 by a separating wall disposed parallel to the rotational axis of the container 201. The edges of the gas transmitting shoe portions which bound the two chambers 213, 215 and face the container 201 are provided with seats which, in the working position of the gas transmitting shoe 211 shown in FIG. 3 lie tight against the outer surface of the cylindrical shell of the container 201. Thus the chambers 213, 215 form two ports facing the shell 201*a*, which together extend approximately over one of the lower quadrants of the container 201. The two chambers are connected with the schematically shown conduits 217, 219 which also comprises couplings not shown in the drawing. Another schematically shown conduit 221 opens into the opening 201*c* provided in the front end of the container 201. In addition, a spraying number 251 with at least one nozzle is provided inside the container 201.

A device for supplying air comprises an air inlet 233 connected with the inlet of a blower 225. The exit of the blower is connected with the inlet of a valve 237 by way of a filter 231, a drying device 233 and a cooling device 235. This valve comprises two exits, one of which is connected with the conduit 217 and thus with the chamber 213 of the gas transmitting shoe and the other is connected with the conduit 221 and thus with the space 261 bounded by the container 201, i.e. with the inside space 261 of the container. The conduit 219 connects the chamber 215 by way of a filter 241 with the inlet of a suction device 243, the exit of which is connected to an air outlet 245. In addition there may be provided temperature and/or humidity feelers and an electronic control device for controlling the operating sequence.

The apparatus of FIG. 2 serves in particular for drying a particulate material, the particles of which were previously coated in the container 201 with a coating, and may accordingly comprise additional components required for coating the particles with a coating. Attention is called in this connection to the U.S. Pat. No. 4,476,804, and the International Disclosure Publication WO 82/03972, and corresponding U.S. Pat. No. 4,543,906, which disclose possible embodiments of similar apparatuses serving for coating particles. It is clear that many other components may be used for both coating and drying, and for example at least one additional device for heating and/or for otherwise treating at least one part of the supplied air, as well as additional valves, may be provided, to selectively conduct the supplied air through the many different devices.

It will now be assumed, that a batch of particulate material containing the particles 263 to be dried and perhaps previously coated, are present in the space 261 bounded by the container. Preceding the drying or at the beginning of the drying process the particles are—in analogy to the drying in the apparatus shown in FIG. 1—cooled down low enough, to have the water present in them or on them freeze. For carrying out this freezing process on particles 263 present in a container 201 one may pass for example cold air through the particulate material or mix the particles with dry ice introduced through one of the openings 201*c*, or spray a liquid cooling medium onto the particles by means of a supply member 251, or allow the cooling medium to trickle onto the particles, the container 201 being rotating or not, in dependence on the particular selected freezing process. Evidently the freezing process may be carried out with particles located outside the container 201.

The drying of the particles 263 requires the container 201 to be rotated in the direction indicated by an arrow, so that the particles 263 contained therein perform rolling movements and form a particle bed 265 in the quadrant, in which the gas transmission shoe 221 is located. The drying of the particles also requires that rather dry cold air be supplied through the conduit 217 and if needed through the conduit 221 too, and air and water vapor arising during drying be sucked of through the conduit 219. The cold air supplied to the chamber 213 flows at the same time through the perforated shell 201*a* into the lower zone of the particle bed 265 and then arrives through the upper zone of the particle bed and the shell 201*a* into the chamber 215. The cold air conditionally supplied through the conduit 221 is also sucked in the upper zone of the particle bed, through this particle bed zone and the perforated shell 201, into the chamber 215. Attention is called to the currents indicated by arrows.

Figure 3:
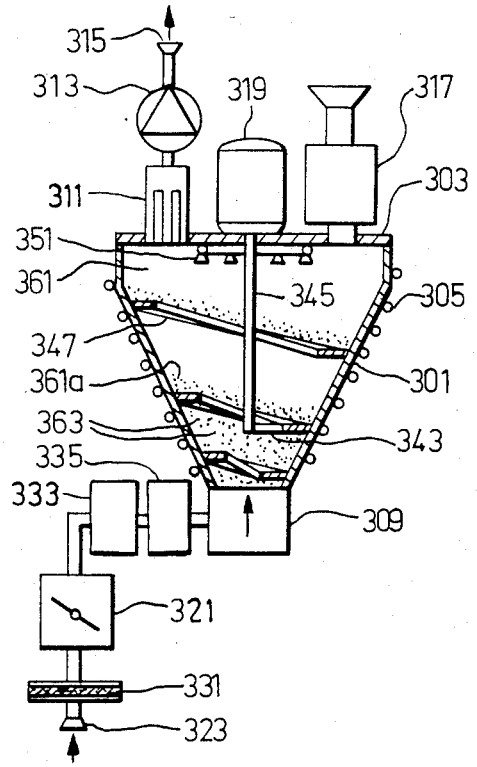
FIG. 3 shows a schematic vertical section through an embodiment of the apparatus, comprising a container and a mechanical movable member provided therein and destined to impart motion to the particulate material.

The apparatus shown in FIG. 3 comprises a container 301 fixedly mounted in a frame not shown in the drawing and comprising a main section conically tapered in downward direction, the wall of said container generally displaying rotational symmetry with respect to a vertical axis. The container 301 is closed at its upper end by means of a cover plate 303 and provided at its lower end with a gas inlet and distributor 309. This gas distributor also includes means for removing the particles, not shown in detail in the drawing, such as a passage to be opened or closed, as desired, by means of a locking member. At least one part of the wall of the container 301 is provided with a cooling and/or heating device 305, such as a cooling coil and/or a heating coil. An inlet 317 provided with a locking member and destined for feeding the particulate material into the container 301 is mounted on the coverplate 303. Also mounted on the cover plate 303 is a filter 311, which pneumatically connects the space 361 bounded by the container 301 tightly closed with respect to the surroundings, i.e. the inner space 361 of the container 301, with the inlet of a suction device 313, the exit of which is connected with the air outlet 315. An air inlet 323 is connected with the gas inlet and distributor 309 through a filter 331, a valve 321, a drying device 333 and a cooling device 335. A movable member 343, specifically rotatable around the vertical axis of rotational symmetry, includes a vertical shaft 345, on which is fastened a conveying member 347 consisting of a helical band, by means of fastening elements, such as thin radial rods. The conveying member 347 has for example an approximately rectangular cross-section, and abuts at its outer edge against the conical part of the container wall. The radial width of the conveying member 347 measured to the shaft 345 is, at least in the upper part of the container 301, considerably smaller than the inside radius of the container; an opening thus results inside the conveying member, i.e., in the zone near its axis. The shaft 345 is connected through a sealed opening of the cover plate 303 with a driving device 319 and is rotatably supported in the latter and/or the cover plate. The container 301 may also comprise at least a cooling medium supply member 351 mounted for example on the cover plate 303.

The particles 363 to be dried are introduced in batches into the space 361 through the inlet 317. The apparatus shown in FIG. 3 could be adapted to agglomerate in the space 361 the particles to be dried, or to coat them with a coating, preceding the drying process. To accomplish the drying, the particles are cooled—in analogy to the process previously described with reference to the FIGS. 1 and 2—low enough, to make the water to be extracted from them, freeze. This freezing process may be accomplished for example by passing cold air from below through the particles 363 or by intermixing the particles with dry ice powder introduced through the inlet 317, or to let liquid air or liquid nitrogen trickle onto the particles by way of the supply member 351. In this case, the wall of the container 301 may be cooled by way of the device 305, and, if need be, the movable member 343 may be cooled by some additional device, and the freezing process may be carried out, depending on the process details decided upon, either with a stationary or with a rotating movable member 343. For the rest, the particles may be subjected to a freezing process outside the container 301, by the use of the apparatus of FIG. 3, or perhaps by first freezing a solution and then produce the particles therefrom by mechanical crushing.

The drying of the particles 363 located after the freezing process in the space 361 is accomplished by rotating the movable member 343 to make its conveying member 347 convey particles 363 along the wall of the container 301 in an upward direction, after which, due to the force of gravity, the particles again fall, on the inside of the conveying member, toward the bottom. At the same time, cold air is sucked by the suction device 313 from the bottom to the top and through the particles 363, as is illustrated by arrows. The device 305 may serve, depending on the requirements, to cool or under certain circumstances to heat at least one part of the container wall, with which the particles come in contact during the motion they are imparted by the helical conveying member 317. If need be, a separate device may be provided to heat or under certain circumstances to cool that part of the movable member 343 which comes in contact with the particles.

Figure 4:
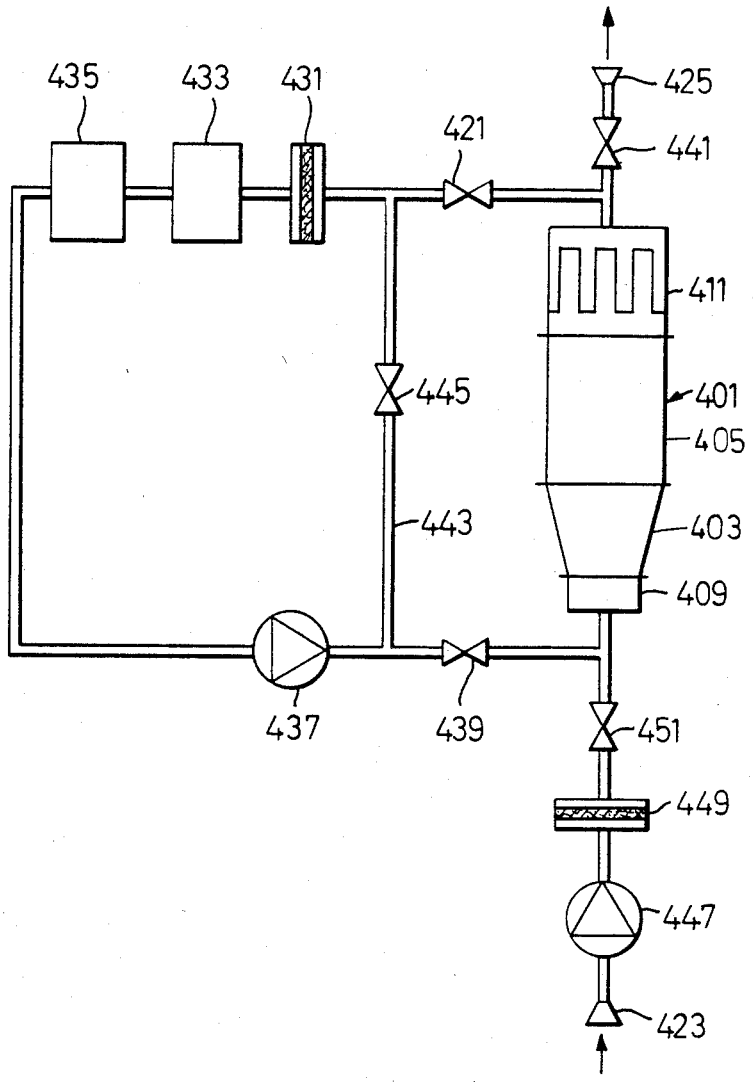
FIG. 4 shows schematically another embodiment of an apparatus for producing a whirling layer and FIG. 5 shows schematically another embodiment of an apparatus for producing a whirling layer.

The apparatus shown in FIG. 4 comprises a whirling layer drier provided with a container 401 having a conical lower part 403 and a cylindrical upper part 405, which may be constructed similar to the container 1 of the apparatus shown in FIG. 1, with the difference, that no suction device is provided above the filter 411, which corresponds to the filter 11. The exit of the filter 411 is connected by way of a valve 421 and a fine filter 431, a gas drying device 433 and a gas cooling device 435, with the inlet of a pump device 437, the exit of which is connected by way of a valve 439 with the gas distributor 409 disposed on the underside of the container 401. A by-pass branch 443 provided with a valve 441 leads from the conduit connecting the exit of the filter 411 with the valve 421, to an air outlet 425. The conduit going from the outlet of the pump device 437 to the valve 439 is connected, by way of a bypass bridging over the container 401 and comprising a valve 445, with the conduit going form the valve 421 to the fine filter 431. A source of pressurized air comprising for example an air inlet 423, a pump device 447 and a filter 449 is connected by way of a valve 451 with the conduit going from the valve 439 to the gas distributor 409.

During the operation of the apparatus shown in FIG. 4, a batch of the particulate material to be dried may be introduced into the container 401, the valves 441, 445, 451 closed, the valves 421, 439 opened; air may be conveyed by means of the pump device 437 in a cycle, through the container 401, the fine filter 431, the gas drying device 433 and the gas cooling device 435. As soon as the batch of particulate material is dried, the valve 445 may be opened, the valves 421, 439 closed, the valves 441, 451 opened and dry air at approximately room temperature may be passed by means of the pump device 447 through the container 401 and the particulate material provided therein, thus heating the container 401 and the particulate material enough, to assure that no humidity settles on the inside wall of the container 401 and on the particulate material upon contact with the surrounding air. The container 401 may then be opened and the batch of dried material may be removed from the container 401 and a new batch of particulate material to be dried may be introduced into the container 401. During this change of batches air may be conveyed in a cycle by means of the pump device 437, through the bypass 443, the fine filter 431 and the devices 433 and 435, so that after introducing the new batch dry cold air is immediately available again.

The apparatus of FIG. 4 was used among others for laboratory experiments of drying water-containing granulated material such as lactose or mannite. The sizes of the batches of particulate material were about 400 g and the particulate material was subjected to whirling using a rate of air flow of about 250 $m^3/h$. The walls of the conical lower part 403 and of the cylindrical upper part 405 of the container 401 were not cooled with particular cooling devices, but only provided with heat insulation, their temperature thus becoming approximately equal to the temperature of the air passing through the container 401. The air dried and cooled by the devices 433, 435 had upon its entry into the container 401 a relative humidity of approximately 30% or less, depending on its temperature. In these experiments it was possible to dry granulated material having an initial water content of about 15 weight percent of its total weight, at a temperature of the air supplied to the container 401 of −10° C. in about 25 to 30 minutes, and at a temperature of −5° C. in about 20 to 25 minutes, to such an extent, that the water content sank to at most 2 percent of the weight. During the whirling process the temperature of the particles fell, because of the sublimation heat withdrawal, to probably sightly below the temperature of the air, so that at least during a large part of the drying process at least a considerable part of the water contained in the particles was in solid state.

Experiments were also carried out, in which a particulate material was produced from a watery mannite-solution by freezing drop-like portions of it in a mould at about −70° C. This particulate material was dried in the container 401 by means of air having for example temperatures between −10° C. and −5° C. In these experiments too, in which the particulate material was removed form the container 401 without being previously heated, powerful drying effects could be observed.

Figure 5:
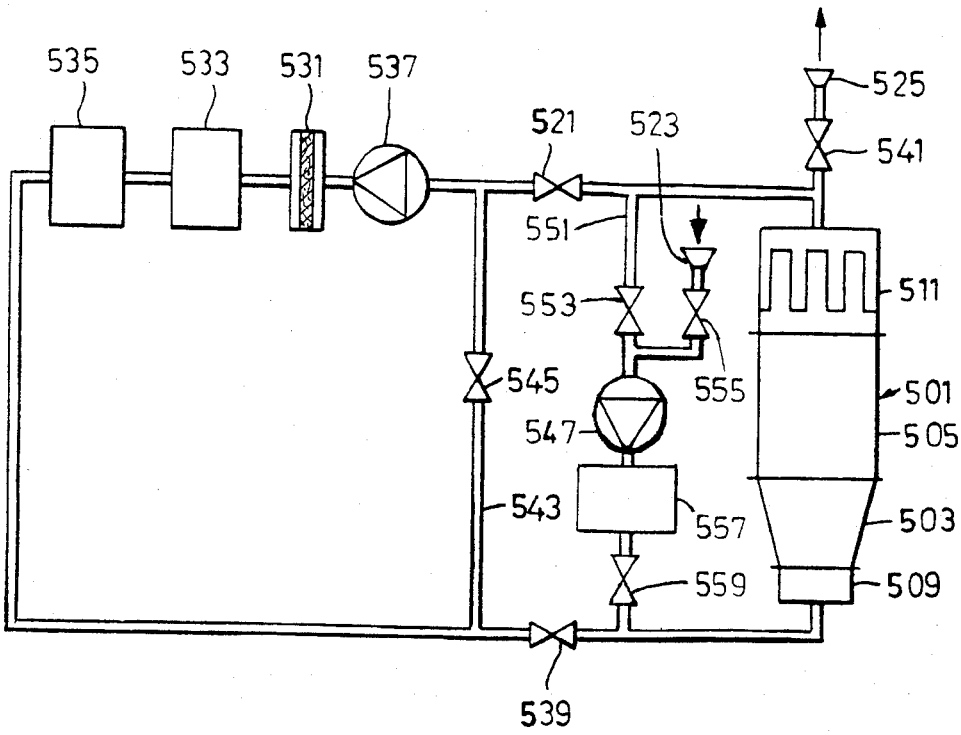

The apparatus shown in FIG. 5 comprises members 501, 503, 505, 509, 511, 521, 525, 531, 533, 535, 539, 541, 543, 545 arranged in a similar manner and performing a similar function as the members with a reference numeral by 100 lower of the apparatus according to FIG. 4. The apparatus shown in FIG. 5 distinguishes from the apparatus represented in FIG. 4 by the fact that the pump device 537 is arranged in the connection between the connection of the two valves 521, 545 and the entry of the fine filter 531. It is, however, mentioned that the pump device 537 could also be arranged in the loop at a place corresponding to that of the pump device 437. The apparatus shown in FIG. 5 comprises in addition to the bypass branch 543 a second bypass branch 551 bridging the container 501 and connecting the connection of the filter 511 with the valve 521 with entry of the gas distributor 509. The branch 551 is provided with a valve 553, a pump device 547, a gas heating device 557 and a valve 559. An air inlet 523 is connected over a valve 555 with the connection connecting the valve 553 with the pump device 547. It is self-evident that the valves 553, 555 could be replaced by a single branch valve.

Now it is assumed that a batch of particulate material is arranged in the container 501 and has been cooled in one of the precedingly described manners so low that the water and/or other substance to be extracted in the drying process has been at least in part and preferentially completely frozen. During the drying process, the valves 521, 539 are open whereas all the other valves shown in FIG. 5 are closed. The pump device 537 pumps air in cycle through the fine filter 531, the gas drying device 533, the gas cooling device 535, and the container 501 so that the particulate material comprised in the latter is fluidized, forms a whirling layer and is dried, whereby the drying occurs at least in part and perferentially completely by sublimation. The pump device 547 and the gas heating device 557 are switched off during this drying process.

When the batch of particulate material has been dried, the valve 545 is opened and the valves 521, 539 are closed. The valves 553, 559 are also opened and the pump device 547 and the gas heating device 557 are set in operation. The pump device 547 pumps now air in cycle through the bypass branch 551 and the container 501 whereby the air flow rate is preferentially sufficiently high for forming a whirling layer in the container 501. The heating device 557 heats the air for instance to about room temperature. If the now dry particulate material comprised in the container 501 can withstand a higher temperature without damages, the heating device can also heat the air to temperatures somewhat higher than room temperature The particulate material and the walls of the container are now warmed approximately to room temperature. This assures that no humidity stemming from the ambient air settles on the particulate material and the inside walls of the container 501 when the latter is opened for replacing the batch of dried material by a new batch of particulate material. During the warming up of the dried material and the change of batches air may be conveyed in a cycle by means of the pump device 537 through the fine filter 531, the devices 533, 535 and the bypass 543, so that after introducing the new batch of particulate material to be dried cold air is immediately available again. The apparatus according to FIG. 5 allows, thus, to perform the drying of the particulate material as well as the following warming up process by circulating air in a closed loop. If necessary or desired one can, however, let stream air out by the outlet 525 or in by the inlet 523 whereby the room in which the inlet 523 opens my possibly comprise air conditioned in some way so that it has for instance a defined temperature and/or humidity.

If particulate materials have to be dried that are not sensitive to elevated temperatures, the apparatus shown in FIG. 5 can also be operated in a conventional manner in which the temperature of the particles is during the drying process above the melting temperature of the water and/or other substances to be extracted. In this case the valves 521 and 539 are closed during the drying process and the pump device 537 and the devices 533, 535 are in the off state during the drying process. The air needed for drying the particulate material is then conveyed by the pump device 547 the container 501 and heated by the heatings device 557 to an appropriate temperature that may in this case be considerably higher than the ambient temperature. The valve 553 can be closed and the valves 541, 555 can be opened so that air is sucked in through the inlet 523 and blown out through the outlet 525. If one provides the loop with a gas drying device for instance arranged between the pump device 547 and the heating device 557 the air can also be circulated in a closed loop.

If in the devices shown in FIGS. 1, 3 and 5 air is sucked from the upper part of the container 1 or 301 or 501 by means of the suction device 13 or 313 or 537, as the case may be, the pressure in the container possibly drops to a value lying slightly below the pressure of the surroundings, while in the container 401 according to FIG. 4 a slight excess in pressure with respect to the surroundings may arise, the pressure differences being however relatively slight. The apparatus shown in FIG. 2 may be operated to make the pressure in the space 261 bounded by the rotatable container 201 be equal to the pressure existing in the surroundings of the apparatus, whereby however the pressure by be readily adjusted to a smaller or larger value. In the spaces provided in the embodiments of the apparatus and containing the particulate material it is thus possible to maintain during the drying process a pressure a least equal to a pressure lying by 30% below the surrounding pressure or for example a pressure at least approximately equal to the surrounding pressure. In the embodiments shown in FIGS. 1 and 3 it is also possible to provide a blower, if needed, and connect it for example upstream of the filter 31 or 331, as the case may be, to blow air into the container 1 or 301, as the case may be, so that a pressure may be produced in these embodiments in the spaces containing the particulate material, which is exactly equal to the surroundings pressure or up to 30% higher than the same.

Under certain circumstances it may be of advantage to dry the particles at a pressure, which lies considerably below the surrounding air pressure. This is possible within certain limits in all embodiments shown in FIGS. 1 to 5, the embodiments of FIG. 3 being specially suited for an operation of this kind. In this embodiment, the pressure prevailing in the space 361 may be set by means of the valve 333 and, if needed, reduced to at most $5 \cdot 10^4$ Pascal, or even to a value amounting to at most $10^4$ Pascal. In all embodiments, however, the pressure should be reduced only to the extent that sufficient heat may be supplied to the particles by way of the air passed through them, to make a fast drying process possible. The pressure in the space containing the particles should be at least $10^3$ Pascal, for practical reasons at least $5 \cdot 10^3$ Pascal and preferably approximately or at least $10^4$ Pascal.

The embodiments shown in FIGS. 1 to 5 and their processes of operation may be modified to have a different gas, such as an inert gas, for example nitrogen, cooled instead of air, and passed through the particulate material introduced into the container of the apparatus in batches, for drying said particulate material.

It is furthermore possible in all of the afore described embodiments of the process of the invention to extract from the particles of the particulate material during drying a different liquid, instead or in addition to the water, which liquid is solidified in a solidification process. A liquid of this kind may be for instance an organic solvent, such as alcohol or isopropanol.

The apparatus shown in FIGS. 2 and 3 may be modified so as to make it possible to convey the gas passed through the particulate material within a cycle; as it is the case for the apparatuses of FIGS. 1, 4 and 5. A closed gas cycle may be of particulate advantage of a gas different from air is passed through the particulate material and or if instead of water vapor a different vapor is extracted during drying. Furthermore, it may be possible to equip all of the embodiments shown in FIGS. 1 to 5 with devices adapted to recover, from the gas that was passed through the particulate material, energy and/or any vaporized substance that has entered the gas during the drying process.

In the apparatus shown in FIG. 2 it would be possible to pneumatically connect the two chambers 213, 215 of the gas transmission shoe 211 in parallel and to suck from both chambers or perhaps to blow into both chambers; in the latter case it would evidently be necessary, to carry away gas from the container 201 by way of the conduit 221.

The drying processes according to the invention can be favorably applied on material that are directly or indirectly sensitive to elevated temperatures and/or oxidation effects. Such materials are, in addition to those already cited, materials comprising for instance as pharmaceutical active substances proteins, peptids, lipids, such as phospholipids, or lipoproteins. These active substances may be synthetic substances ar can be of natural origin and can for instance be formed by enzymes or by compontents of microorganisms.

The apparatuses shown in the FIGS. 1 to 5 may be used for drying materials that have been wetted in the same containers during preceding agglomerating and/or coating processes as already several times mentioned. These preceding processes during which a wetting of particulate materials occurs can be performed according to one of the manners described in my copending application U.S. patent application Ser. No. 735,265 filed together with this application and having the priority of the Swiss application No. 2483/84 of May 19, 1984. The apparatus disclosed in the two applications may then be combined and modified in a manner to allow a wetting and a following drying.

Previously, specific embodiments of the present invention have been described. It should be appreciated, however, that these embodiments have been described for the purposes of illustration only, without any intention of limiting the scope of the present invention. Rather it is the intention that the present invention be limited only by the appended claims.

What is claimed is:

1. A process for drying particulate material that includes a liquid substance to be extracted, the process comprising the steps of: freezing the material within a container in a freezing operation and subsequently drying the material in the same container in a drying operation, wherein a cooling medium having one of the states solid and liquid and particles of the said material are subjected to movement during the said freezing operation in the said container, so that the particles of the material are cooled to a temperature at which the liquid substance is solidified and wherein the cooling medium is separated from the particulate material in the gaseous state, and wherein the particulate material, after the solidification of the liquid substance is dried during the drying operation in the same container by passing gas through the particulate material and subjecting the particulate material to motion, wherein the particulate material is held at least during a part of the drying operation at a temperature at which at least a part of the substance to be extracted from it remains in the solid state until it is extracted by sublimation, and wherein vapor generated during the drying operation is carried away from the particulate material by the gas passed through the particulate material together with said gas.

2. A process according to claim 1, wherein said particles including said liquid substance are formed at least in part in the same container in which they are later dried during said drying operation.

3. A process according to claim 1, wherein the temperature and the quantity of the gas passing through the particulate material during the drying operation when the substance to be extracted is undergoing sublimation are sufficient to supply the particulate material with at least one part of the quantity of heat required for drying, and to hold the particulate material at least during a part of the drying operation at a temperature at which at least one part of the substance to be extracted from it is in the solid state.

4. A process according to claim 3, wherein the substance to be extracted from the particulate material consists of at least one component of a mixture, the particulate material being held at least during one part of the drying operation at a temperature at which the mixture is—at least at the prevailing mixing proportions—completely rigid.

5. A process according to claim 4, wherein the particulate material is held at least during part of the drying operation at a temperature at which the mixture is completely rigid at all possible mixing proportions.

6. A process according to claim 1, wherein the gas when supplied to the particulate material during the drying operation and before it comes in contact therewith contains the substance to be extracted from the particulate material, at the most in the form of unsaturated vapor.

7. A process according to claim 1, wherein the density of any vapor present in the gas when supplied to the particulate material during the drying operation and before it comes into contact therewith, is not more than 40% of the density of saturation, and in which the vapor has the temperature of the supplied gas.

8. A process according to claim 1, wherein the particulate material is whirled during the freezing operation and during the drying operation by the gas passed through it, to form a whirling layer.

9. A process according to claim 1, wherein the particulate material is dried in a container provided with a wall at least partially perforated, the container is rotated around a rotational axis disposed at an angle with respect to the vertical, and the gas is passed through at least one part of the bed formed in the container by the particles and through at least one part of the zone of the perforated wall momentarily covered by the said bed during the freezing operation and during the drying operation.

10. A process according to claim 1, wherein motion is imparted to the particulate material by a driving member, the latter being effective to convey the particles in an upward direction and the particles being arranged to fall back in a downward direction due to the force of gravity, the gas being passed vertically upward through the particulate material during the freezing operation and during the drying operation.

11. A process according to claim 1, wherein the particulate material is dried in a space in which the pressure is at least $10^4$ Pascal.

12. A process according to claim 1, including the step of forming said particles comprising said substance at least in part by a treatment with a liquid in the container before drying the particles in the container.

13. A process according to claim 1, wherein the substance to be extracted is water and air is used as the cooled gas and is dried and cooled to a temperature below the melting temperature of ice before being passed through the particulate material.

14. A process according to claim 1, wherein said freezing operation includes introducing dry-ice particles into the container.

15. A process according to claim 1, wherein said freezing operation includes introducing one of liquid nitrogen and liquid air into the container.

16. A process according to claim 1, wherein during said freezing operation a gas is cooled and passed through the container and through the particulate material provided in the container.

17. A process as claimed in claim 1, wherein the temperature and the quantity of the gas introduced into the container during the drying operation are sufficient to supply the particulate material with at least one part of the quantity of heat required for drying, and to hold the particulate material during the entire drying operation at a temperature at which the entire substance to be extracted from it is in the solid state until it sublimes.

18. A process for drying a particulate material having a substance to be extracted during a drying operation and originally being in the liquid state and having been at least in part solidified by cooling, said process including the steps of:

(a) drying a batch of the particulate material in a container while subjecting the material to movement and to gas passing through it in such a way that the material is kept at least during a substantial part of the drying operation at a temperature low enough for maintaining at least a part of the substance to be extracted from the particulate material in the solid state until it is sublimed;

(b) subsequently introducing into the container gas with a higher temperature than the temperature of the gas passed through the container during the drying operation to perform a warming-up operation within the container and the batch of dried particulate material provided therein for warming up the inside of the container and the batch of dried particulate material to a temperature high enough to ensure that substantially no humidity condenses on the inside wall of the container and on the dried particulate material upon contact with the air from the surroundings; and (c) removing the dried batch of particulate material from the container after the warming-up operation.

19. A process according to claim 18, wherein the gas passed through the container and the particulate material provided therein during the drying operation is circulated in a closed loop and dried and cooled in drying and cooling means between its leaving the container and re-entering it, and wherein during said warming-up operation and during the removing of the dried batch of particulate material gas is circulated in a closed loop through said drying and gas cooling means and through a by-pass branch bridging said container.

20. A process as claimed in claim 18, wherein the gas passed through the container and through the particulate material during the warming-up operation is circulated in a closed loop and heated in a heating device between its leaving the container and re-entering it.

21. A process for drying a particulate material that includes a liquid substance to be extracted, said process comprising the following steps:

(a) introducing into a container particulate material that includes a liquid substance to be extracted;

(b) cooling the particulate material while it is within the container to a temperature sufficient to freeze the liquid substance into the solid state;

(c) flowing a cooled gas through the particulate material in an amount sufficient to impart to the particles a whirling motion while the material is being cooled in the container;

(d) continuing the flow of cooled gas after solidification of the substance to be extracted in order to dry the particles within the same container in which the particles are cooled by transforming the solidified substance to be extracted to a vapor by sublimation, the flow of cooled gas being of a sufficient amount to fluidize the particles to form a whirling layer while drying is taking place; and (e) withdrawing the vapor from the container with the cooled gas that flows through the particulate material.

22. Apparatus for drying a particulate material comprising: a container to receive a batch of particulate material to be dried; gas conducting means connected with said container forming together with said container a closed loop that includes gas pumping means and drying means and cooling means for drying and cooling a gas and passing the dried and cooled gas through said container at a temperature low enough to ensure that at least a part of the substance to be extracted from the particulate material during a drying operation is at least during a part of the drying operation in the solid state, wherein the gas conducting means further comprises valve means for disconnecting said cooling means from the closed loop during a warming-up operation and a batch-removing operation, and heating means for passing gas through the container during the warming-up operation at a temperature exceeding the temperature of the gas passed through the container during the drying operation for warming up the inside of said container and the batch of particulate material provided therein to a temperature high enough to ensure that substantially no humidity condenses inside said container and on the particulate material upon contact with air from the surroundings when the container is opened and the batch of dried particulate material is removed from the container.

23. Apparatus according to claim 22 including additional cooling means for cooling a surface with which particles of the particulate material come in contact during the drying operation.

24. Apparatus according to claim 22 further comprising means for imparting motion to the particles when they are within the container.

25. Apparatus as claimed in claim 22, further comprising a by-pass branch bridging said container and further comprising valve means for permitting gas to be circulated through said drying and cooling means and said by-pass branch during the warming-up operation and during the time when the dried batch of particulate material is removed from the container.

26. Apparatus as claimed in claim 25, wherein said container comprises a conical lower part tapering downwardly, a cylindrical upper part, a gas inlet means disposed on an underside of said lower part, and a gas outlet means comprising a filter means arranged at an upper end of said upper part so that said particulate material can be whirled upwardly by passing cooled gas from said inlet means upwardly through said container toward said filter means during the drying operation to form a whirling layer, wherein the two ends of said by-pass branch are each connected with said gas inlet means and gas outlet means, respectively, and said branch includes a valve, and wherein the lower part of the container is separably mounted to the rest of the container.

27. Apparatus as claimed in claim 22, further comprising heating means connected through valve means with a gas-outlet means and a gas-inlet means of said container so that gas can be circulated during said warming-up operation in a closed loop through said heating device and said container.

* * * * *